US011549510B2

(12) United States Patent
Seo et al.

(10) Patent No.: US 11,549,510 B2
(45) Date of Patent: Jan. 10, 2023

(54) MOTOR-OPERATED COMPRESSOR

(71) Applicant: LG ELECTRONICS INC., Seoul (KR)

(72) Inventors: Bumjune Seo, Seoul (KR); Ochang Gwon, Seoul (KR); Yongsoo Cho, Seoul (KR); Jongtae Her, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 313 days.

(21) Appl. No.: 16/516,598

(22) Filed: Jul. 19, 2019

(65) Prior Publication Data

US 2020/0080556 A1 Mar. 12, 2020

(30) Foreign Application Priority Data

Sep. 6, 2018 (KR) ..... 10-2018-0106676

(51) Int. Cl.
*F04C 18/02* (2006.01)

(52) U.S. Cl.
CPC ..... *F04C 18/0215* (2013.01); *F04C 2240/30* (2013.01); *F04C 2240/40* (2013.01); *F04C 2240/603* (2013.01)

(58) Field of Classification Search
CPC .. F04C 2240/603; F04C 18/0207–0292; F04C 2240/40; F04C 29/023;
(Continued)

(56) References Cited

U.S. PATENT DOCUMENTS 4,551,082 A * 11/1985 Hazaki ..... F04C 29/023 418/94
4,597,720 A * 7/1986 Friedrichs ..... F04B 53/08 417/419
(Continued)

FOREIGN PATENT DOCUMENTS

JP 2001-304127 A 10/2001
JP 2003-336578 A 11/2003
(Continued)

OTHER PUBLICATIONS

Office Action dated Sep. 20, 2019, in Korean Patent Application No. 10-2018-0106676 (6 pp.).

*Primary Examiner* — Thomas Fink
(74) *Attorney, Agent, or Firm* — Birch, Stewart, Kolasch & Birch, LLP

(57) ABSTRACT

A motor-operated compressor includes a compression unit including a compression chamber formed by a plurality of scrolls engaged with each other. The compressor includes a rotation shaft having one end coupled to one of the scrolls and a rotor coupled with another end of the rotation shaft. The compressor includes a stator radially separated from the rotor by a predetermined gap. The compressor includes a casing having a motor chamber. The stator is inserted in the motor chamber and divides the motor chamber into a first space and a second space. The casing includes an inlet port coupled to the first space to guide a refrigerant toward the motor chamber. The casing also includes a suction guide passage coupled to the second space to guide the refrigerant sucked through the inlet port toward the compression unit. A communication passage portion in the rotation shaft communicates the first and second spaces.

6 Claims, 11 Drawing Sheets

(58) Field of Classification Search
CPC ..... F04C 29/045; F04B 17/03; F04B 53/08; F04B 53/006; F04B 39/06–068; F04B 39/0246–0253; F04B 39/0094–02; H02K 9/00–28
See application file for complete search history.

(56) References Cited

U.S. PATENT DOCUMENTS

| | | | | |
|---|---|---|---|---|
| 4,936,756 | A * | 6/1990 | Shimizu | F04C 23/008 417/371 |
| 6,494,696 | B2 * | 12/2002 | Terai | F04C 29/028 418/94 |
| 2003/0143090 | A1 * | 7/2003 | Iritani | F04C 23/008 417/410.5 |
| 2004/0258542 | A1 * | 12/2004 | Wiertz | F04C 29/042 417/410.5 |
| 2006/0257272 | A1 * | 11/2006 | Hori | F04C 18/0215 417/410.5 |
| 2016/0123325 | A1 * | 5/2016 | Kim | F04C 18/0223 73/53.01 |
| 2016/0333880 | A1 * | 11/2016 | Onara | F04C 18/0215 |
| 2017/0292517 | A1 * | 10/2017 | Lee | F04C 18/0215 |
| 2018/0135612 | A1 * | 5/2018 | Bae | F04B 39/0005 |
| 2018/0252216 | A1 * | 9/2018 | Lee | F04C 18/0253 |

FOREIGN PATENT DOCUMENTS

| | | | |
|---|---|---|---|
| JP | 2016-005325 | A | 1/2016 |
| KR | 10-2004-0107728 | A | 12/2004 |
| KR | 20130024491 | A | 3/2013 |

* cited by examiner

MOTOR-OPERATED COMPRESSOR

CROSS-REFERENCE TO RELATED APPLICATION

Pursuant to 35 U.S.C. § 119(a), this application claims the benefit of an earlier filing date of and the right of priority to Korean Application No. 10-2018-0106676, filed on Sep. 6, 2018, the contents of which are incorporated by reference herein in their entirety.

BACKGROUND OF THE DISCLOSURE

1. Field of the Disclosure

The present disclosure relates to a scroll type motor-operated compressor.

2. Background Art

Generally, compressors for compressing a refrigerant in automotive air conditioning systems have been developed in various forms. Recently, motor-operated compressors driven by electric power using motors have been actively developed according to the tendency of electricization of electric parts of vehicles.

A motor-operated compressor mainly employs a scroll compression method suitable for a high compression ratio operation. Such a scroll type motor-operated compressor (hereinafter, abbreviated as a motor-operated compressor) is disclosed in Patent Document (Korean Patent Laid-Open Publication No. 10-2013-0024491).

In the related art motor-operated compressor disclosed in the patent document, a protrusion is formed on outer circumferential surface of a motor unit housing constituting a casing, and a suction flow path recessed toward an outer circumferential surface of the protrusion is formed on an inner circumferential surface of the protrusion. A plurality of protrusions disposed in a circumferential direction with predetermined intervals is provided, and the plurality of protrusions are provided with the suction flow paths, respectively. Accordingly, the suction flow path is spaced from an outer circumferential surface of a stator, which is press-fitted into an inner circumferential surface of the motor unit housing, thereby forming a passage through which a refrigerant can move between both spaces of a driving motor.

In the related art motor-operated compressor, the refrigerant is sucked into an inner space of the motor unit housing through a refrigerant inlet port. The refrigerant then flows to an opposite side of the driving motor through a gap between the stator and a rotor and through the suction flow path of the motor unit housing, spaced from the outer circumferential surface of the stator, thereby being introduced into a compression unit.

However, in the related art motor-operated compressor, as the plurality of suction flow paths are recessed into the inner circumferential surface of the motor unit housing along the circumferential direction with the predetermined intervals, the inner circumferential surface of the motor unit housing and an outer circumferential surface of a stator core are spaced apart from each other at plural portions along the circumferential direction. As a result, a radial supporting force for supporting the stator in a radial direction becomes uneven and thereby deformation of the stator core may occur. As a result, a gap between the stator and the rotor becomes uneven, causing deterioration of motor efficiency and increase in vibration noise of the compressor.

Further, in the related art motor-operated compressor, since the plurality of suction flow paths are formed at the outer circumferential surface of the stator, there is a limit to enlarge an outer diameter of the stator. As a result, the outer diameter of the stator is reduced rather than an outer diameter of the casing and thereby an output of the motor is reduced. On the contrary, a length of the motor increases rather than the output of the motor, thereby increasing a length of the compressor.

Further, in the related art motor-operated compressor, an area of a refrigerant passage communicating a front space and a rear space with each other on the basis of the driving motor may be limited inside the driving motor. In particular, when a coil wound on the stator core is wound in a distributed winding form, the refrigerant passage cannot be formed between wound coils, and thereby the refrigerant cannot move quickly to the compression unit. As a result, the suction flow path is formed widely between the inner circumferential surface of the motor unit housing and the outer circumferential surface of the stator so that the refrigerant in the front space can flow to the rear space, which causes the aforementioned problem.

SUMMARY OF THE DISCLOSURE

One aspect of the present disclosure is to provide a motor-operated compressor, capable of enhancing motor efficiency and suppressing vibration noise by maintaining a uniform gap between a stator and a rotor in a manner of making rigidity of a casing uniform in a circumferential direction.

Further, it is an aspect of the present disclosure to provide a motor-operated compressor, capable of suppressing deformation of a stator by minimizing an area spaced between an inner circumferential surface of a casing and an outer circumferential surface of the stator.

Another aspect of the present disclosure is to provide a motor-operated compressor, capable of enhancing motor efficiency or performance by enlarging an outer diameter of a stator with respect to a casing having the same outer diameter, and simultaneously minimizing a size of the compressor by reducing a length of a motor with respect to a motor having the same output.

Still another aspect of the present disclosure is to provide a motor-operated compressor, capable of allowing a refrigerant sucked into an inner space of a casing to quickly flow toward a compression unit located at an opposite side through a motor, while excluding or minimizing a refrigerant passage between an inner circumferential surface of the casing and an outer circumferential surface of a stator.

Further, it is an aspect of the present disclosure to provide a motor-operated compressor, capable of ensuring a wide refrigerant passage within an outer circumferential surface range of a motor.

In order to achieve the aspects of the present disclosure, there is provided a motor-operated compressor, including a casing, a driving motor disposed in an inner space of the casing to divide the inner space of the casing into a front space and a rear space, a compression unit to compress a refrigerant by receiving a rotational force of the driving motor, and a rotation shaft having one end coupled to the driving motor and another end coupled to the compression unit to transfer the rotational force of the driving motor to the compression unit, wherein the rotation shaft is provided with a suction communication passage to guide a fluid sucked into the front space toward the rear space.

Here, the suction communication passage may be formed through an inside of the rotation shaft in a lengthwise direction or may be a groove formed with a predetermined depth on an outer circumferential surface of the rotation shaft in the lengthwise direction.

The suction communication passage may be provided with a transfer member to transfer a fluid in the front space to the rear space.

The casing may be provided with a communication groove recessed by a predetermined depth on an inner circumferential surface thereof so as to communicate the front space and the rear space.

Also, in order to achieve the aspects of the present disclosure, there is provided a motor-operated compressor, including a compression unit forming a compression chamber as a plurality of scrolls are engaged with each other, a rotation shaft having one end coupled to one of the plurality of scrolls, a rotor coupled with another end of the rotation shaft, a stator provided at an outer circumferential surface of the rotor with a predetermined gap therefrom, a casing having a motor chamber in which the stator is inserted, the motor chamber divided into a first space and a second space based on the stator, the casing provided with an inlet port formed at the first space to guide a refrigerant toward the motor chamber, and a suction guide passage formed in the second space to guide the refrigerant sucked through the inlet port toward the compression unit, and a communication passage portion provided in the rotation shaft to communicate the first space and the second space.

Here, the communication passage portion may include a first communication hole formed inside the rotation shaft in an axial direction, and a second communication hole formed in a penetrating manner between an inner circumferential surface of the first communication hole and an outer circumferential surface of the rotation shaft so that both ends communication passage portion are accommodated in the first space and the second space, respectively.

The first communication hole may be provided therein with a suction guide member to suck the refrigerant in the first space.

The second communication hole may be provided in plurality formed at predetermined intervals along a circumferential direction.

The second communication hole may be formed at a position radially overlapping a coil located in the second space.

Here, the communication passage portion may be formed by being recessed on an outer circumferential surface of the rotation shaft in a lengthwise direction, and have a first end located in the first space and a second end located in the second space.

The communication passage portion may be formed in a spiral shape, and the communication passage portion may be formed to be wound in a forward direction, with respect to a rotation direction of the rotation shaft, from the first end located in the first space to the second end located in the second space.

Here, the stator may include a stator core having a plurality of teeth formed on an inner circumferential surface thereof along a circumferential direction, and coils wound on the plurality of teeth of the stator core, respectively, and the coils may be wound in a concentrated winding manner so that the communication passage portion is formed between neighboring coils.

Here, the casing may be provided with a communication groove formed on an inner circumferential surface thereof to communicate the first space and the second space.

The communication groove may be formed to be connected to the suction guide passage.

Also, in order to achieve the aspects of the present disclosure, there is provided a motor-operated compressor, including a main housing having a motor chamber communicating with an inlet port, a driving motor having a stator coupled to an inner space of the main housing and a rotor rotatably disposed in the stator, so as to divide the inner space of the main housing into a first space and a second space on the basis of the stator, a rotation shaft coupled to the rotor of the driving motor, a first scroll eccentrically coupled to the rotation shaft to perform an orbiting motion, a second scroll coupled to the main housing outside the inner space of the main housing and engaged with the first scroll to form a compression chamber, a rear housing coupled to the second scroll to form a discharge chamber together with the second scroll, an inverter housing coupled to the main housing, and a suction communication passage communicating the first space and the second space of the main housing, wherein the suction communication passage is formed within an outer diameter range of the stator.

Here, the stator may include a stator core having a plurality of teeth formed on an inner circumferential surface thereof, and a plurality of coils wound around the plurality of teeth of the stator core, respectively, and the suction communication passage may include a first communication passage formed between two neighboring coils among the plurality of coils.

The suction communication passage may include a second communication passage formed by a gap between an inner circumferential surface of the stator and an outer circumferential surface of the rotor.

Here, the suction communication passage may include a communication passage portion provided in the rotation shaft to communicate the first space and the second space.

In addition, the communication passage portion may be provided therein with a suction guide member.

Here, the main housing may be provided with a communication groove formed on an inner circumference thereof to communicate the first space and the second space, and the communication groove may be formed in a manner that at least part thereof is located at a lowest point closest to a ground.

Effects of the Disclosure

In a motor-operated compressor according to the present disclosure, as an inner circumferential surface of a main housing and an outer circumferential surface of a stator core are entirely or almost entirely in tight contact with each other, the outer circumferential surface of the stator core can be prevented from being deformed during a process of press-fitting the stator core to the main housing. Thus, substantially the same gap can be maintained between a stator and a rotor, which may result in enhancing motor efficiency and reducing a frictional loss between the stator and the rotor. Also, this may result in suppressing collision noise between the stator and the rotor and vibration caused due to the collision noise.

Also, in a motor-operated compressor according to the present disclosure, a suction communication passage is not formed between a main housing and a stator, which may result in maximizing an outer diameter of the stator. Accordingly, an output of a motor can increase with respect to the same axial length, and a size of the compressor can be reduced by decreasing the axial length of the motor with respect to the same output.

In addition, in a motor-operated compressor according to the present disclosure, since a suction communication passage for communicating a front space and a rear space is formed in a rotation shaft or in an outer circumferential surface of the rotation shaft, a refrigerant introduced into the front space can quickly flow to the rear space even without forming a separate suction communication passage between a main housing and a stator. Accordingly, a suction loss of the compressor can be suppressed, and volume efficiency of the compressor can increase.

DETAILED DESCRIPTION

Description will now be given in detail of a motor-operated compressor according to exemplary embodiments disclosed herein, with reference to the accompanying drawings.

Figure 1:
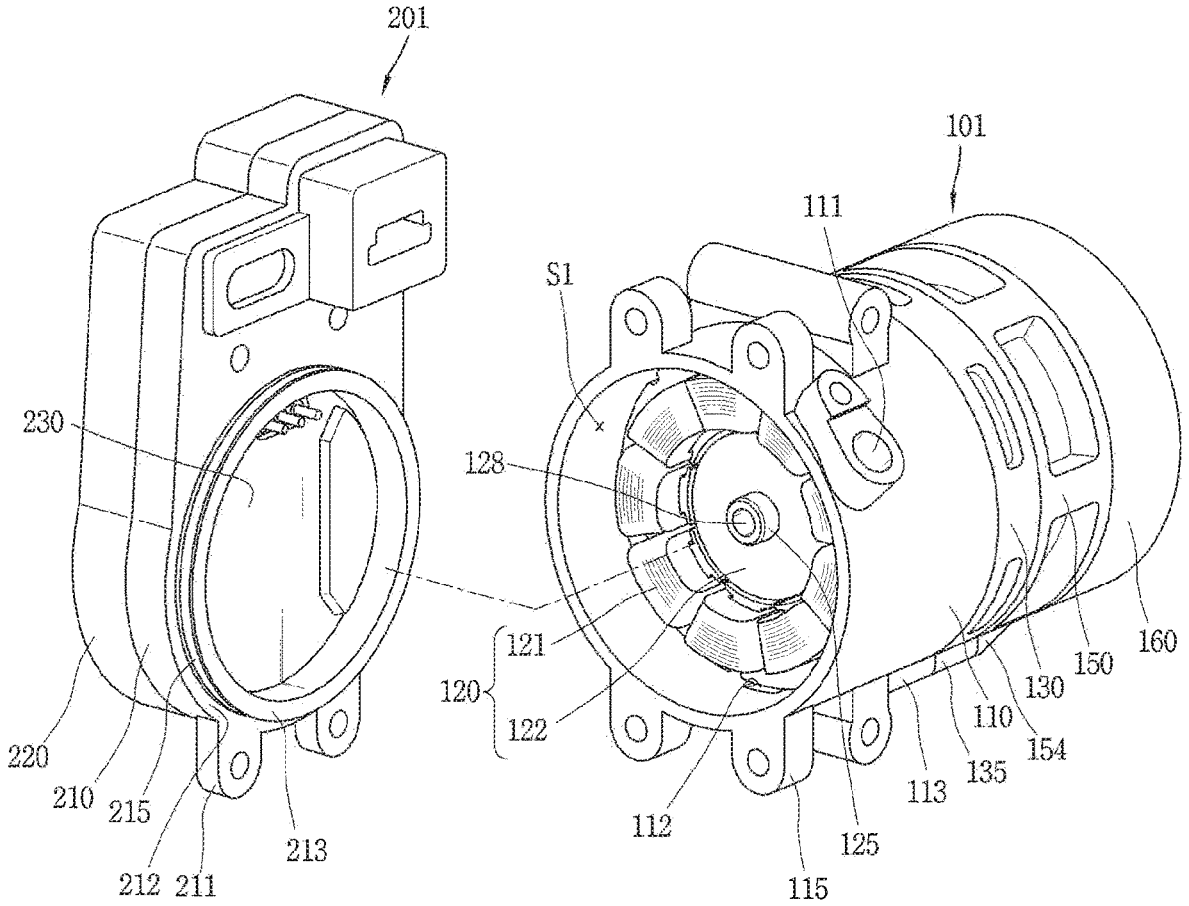
FIGS. 1 and 2 are an exploded perspective view and an assembled sectional view of a motor-operated compressor according to the present disclosure.
Figure 2:
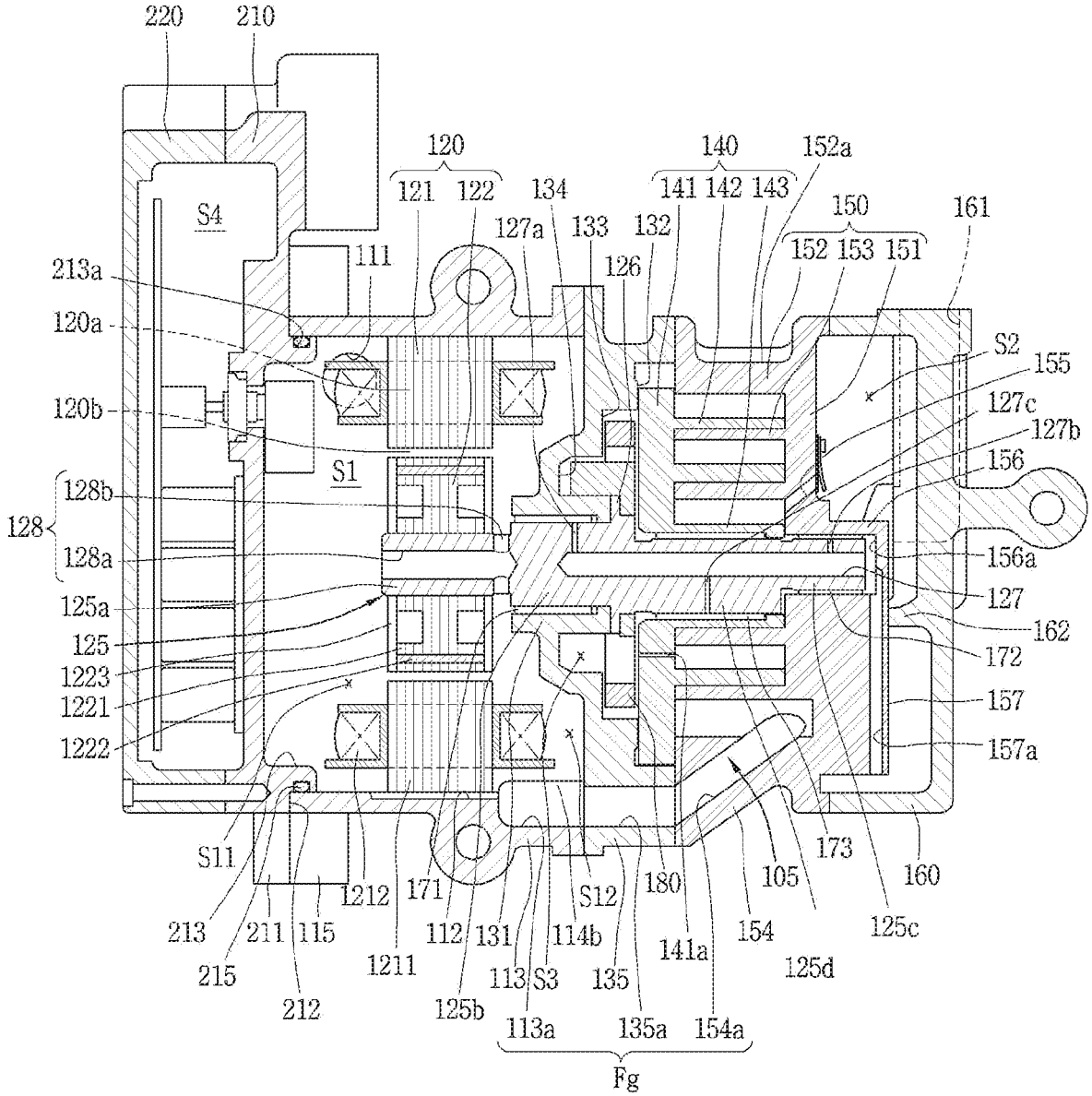
Figure 3:
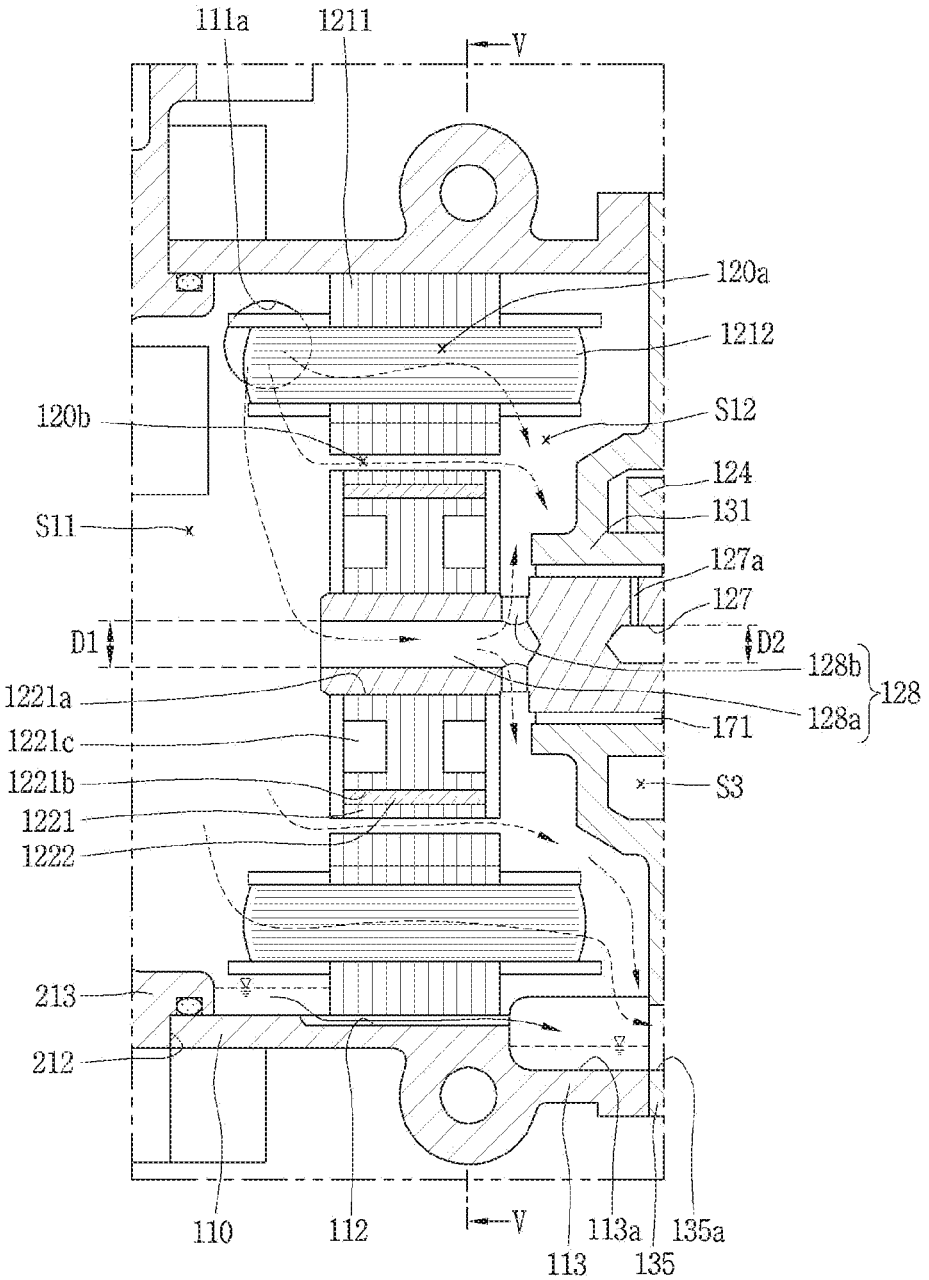
FIG. 3 is an enlarged sectional view of a surrounding of a motor unit in FIG. 2.
Figure 4:
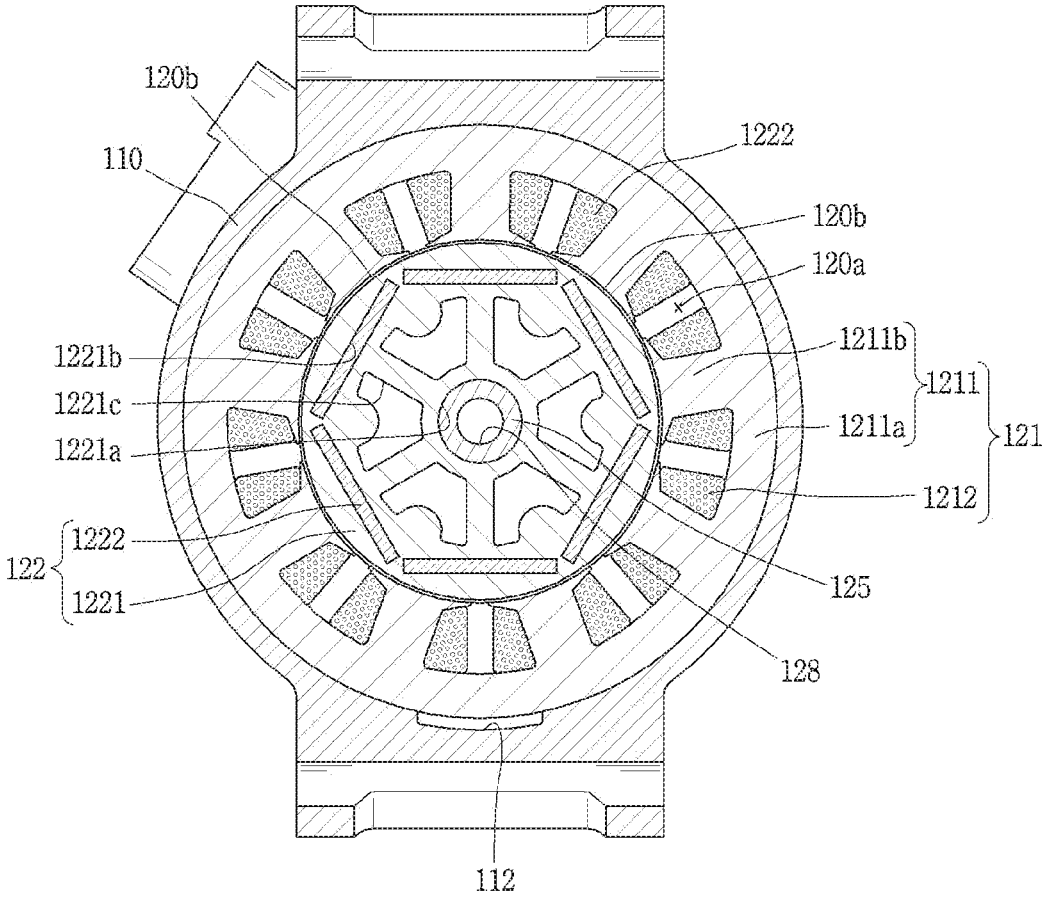
FIG. 4 is a sectional view taken along the line "V-V" of FIG. 3.
Figure 5:
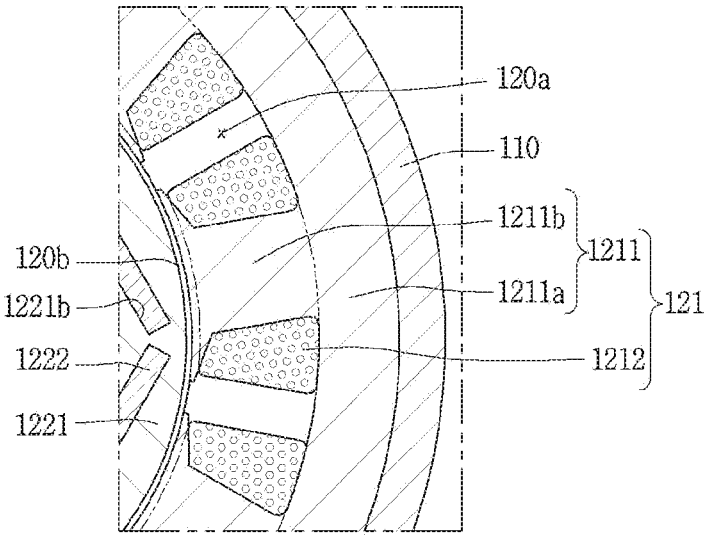
FIG. 5 is an enlarged sectional view of a part of a driving motor, viewed from a front, for explaining a suction communication passage in FIG. 4.

FIGS. 1 and 2 are an exploded perspective view and an assembled sectional view of a motor-operated compressor according to the present disclosure, FIG. 3 is an enlarged sectional view of a surrounding of a motor unit in FIG. 2, FIG. 4 is a sectional view taken along the line "V-V" of FIG. 3, and FIG. 5 is an enlarged sectional view of a part of a driving motor, viewed from a front, for explaining a suction communication passage in FIG. 4.

As illustrated in FIGS. 1 and 2, a scroll type motor-operated compressor (hereinafter, abbreviated as a motor-operated compressor) according to an embodiment of the present disclosure may include a compressor module 101 for compressing a refrigerant, and an inverter module 201 coupled to a front side of the compressor module 101 for controlling an operation of the compressor module 101. The compressor module 101 and the inverter module 201 may be assembled successively, or independently manufactured and assembled. This embodiment illustrates the latter as a representative example, but the former and the latter may alternatively be combined such that the compressor module and the inverter module are independently manufactured but successively assembled.

The compressor module 101 includes a main housing 110 having an inner space forming a motor chamber S1 and provided with an inlet port 111 formed to communicate with the motor chamber S1, a driving motor 120 as a motor unit fixed to the motor chamber S1 of the main housing 110, a frame 130 provided at one side of the driving motor 120 and coupled to the main housing 110 to support a rotation shaft 125 and an orbiting scroll 140 to be described later, a compression unit 105 provided at one side of the driving motor 120 outside the main housing 110 to compress a refrigerant using a rotational force of the driving motor 120, and a rear housing 160 coupled to another side of the compression unit 105 to form a discharge chamber S2.

As the main housing 110 is arranged in a horizontal direction with respect to the ground, the driving motor 120 and the compression unit 105 are also arranged in the horizontal direction. For the sake of explanation, a left side of FIG. 2 is designated as a front side and a right side as a rear side.

As illustrated in FIG. 2, the main housing 110 is formed in a cylindrical shape with both open ends. However, in some cases, a front end of the main housing 110 may be open and a rear end may be integrally formed with a frame so as to be formed in a semi-closed shape. This embodiment will be described by exemplifying a cylindrical shape in which both ends of the main housing are opened.

In the vicinity of the front end of the main housing 110, an inlet port 111 for guiding a refrigerant to an inside of the main housing is formed. Accordingly, the motor chamber S1 forms a kind of suction space. Thus, the motor-operated compressor according to this embodiment is implemented as a low-pressure compressor in which a refrigerant is introduced into the compression unit 105 through the inner space of the main housing 110 forming the motor chamber.

The front end of the main housing 110 is sealed by being coupled to an inverter housing 210 to be described later and the rear end of the main housing 110 is almost sealed by being coupled to the frame 130 supporting the compression unit 105.

In addition, the driving motor 130 constituting the motor unit is press-fitted into the motor chamber S1 of the main housing 110. The driving motor 130 includes a stator 121 fixed to an inner circumferential surface of the main housing 110, and a rotor 122 positioned inside the stator 121 and rotated by interaction with the stator 121. The rotor 122 is coupled with a rotation shaft 125 that transfers the rotational force of the driving motor 120 to the compression unit 105 while rotating together with the rotor 122.

As illustrated in FIGS. 2 to 4, the stator 121 is fixed in a manner that the stator core 1211 is press-fitted (hot pressing) in the inner circumferential surface of the main housing 110. Accordingly, the inner space of the main housing 110 constituting the motor chamber S1 forms a kind of suction space, and is divided into a front space S11 as a first space and a rear space S12 as a second space on the basis of the stator core 1211. The front space S11 is a space communicating with the inlet port 111 and the rear space S12 is a space facing the frame 130.

The stator core 1211 includes a yoke portion 1211*a* formed in an annular shape and forming a magnetic path, and a plurality of teeth 1211*b* radially protruding from an inner circumferential surface of the yoke portion 1211*a* and wound with coils 1212. An outer circumferential surface of the yoke portion 1211*a* is formed in a round shape, and each of the plurality of teeth 1211*b* is formed substantially in a rectangular shape. The coils 1212 are wound around the plurality of teeth 1211*b*, respectively, in a concentrated winding manner. Accordingly, a gap is formed between the neighboring coils 1212 and this gap defines a first suction communication passage (hereinafter, referred to as a first communication passage) 120*a*.

A rotator core 1221 of the rotor 122 is inserted into the stator core 1211 with a predetermined gap from an inner circumferential surface of the stator core 1211. A shaft fixing hole 1221*a* in which the rotation shaft 125 is press-fitted may be formed in a center of the rotor core 1221, a plurality of magnet mounting grooves 1221*b* in which magnets 1222 are inserted may be formed along an edge portion of the rotor core 1221, and dimple grooves 1221*c* for reducing a weight of the rotor 122 may be formed between the shaft fixing hole 1221*a* and the magnet mounting grooves 1221*b*.

The shaft fixing hole 1221*a* is blocked as the rotation shaft 125 is press-fitted therein, and the magnet mounting grooves 1221*b* are blocked as the magnets 1222 are inserted therein. The dimple grooves 1221*c* are opened at the rotor core 1221 but are blocked together with the magnet mounting grooves 1221*b* by end plates 1223 coupled to both ends of the rotor core 1221.

As a result, the suction communication passage for communicating the front space with the rear space is not formed in the rotor 122. However, an outer circumferential surface of the rotor core 1221 is spaced apart from an inner circumferential surface of the stator core 1211 by a predetermined gap and the gap between the rotor core 1221 and the stator core 1211 defines a second suction communicating passage (hereinafter, referred to as a second communication passage) 120*b*. However, in view of the fact that the second communication passage 120*b* substantially communicates with the first communication passage 120*a*, the first communication passage 120*a* and the second communication passage 120*b* may also be defined as one suction communication passage. However, when the coil 1212 is wound in a distributed winding manner, the first communication passage 120*a* is not formed. Therefore, the first communication passage and the second communication passage will be described separately in this embodiment in order to clearly show that the first communication passage 120*a* is formed as the coils 1212 are wound in the concentrated winding manner.

As illustrated in FIG. 2, a shaft portion 125*a* forming a front end of the rotation shaft 125 is integrally coupled to the shaft fixing hole 1221*a* of the rotor 122. A main bearing portion 125*b* and a sub bearing portion 125*c* forming a rear end of the rotation shaft 125 are inserted into a first bearing 171 of the frame 130 and a second bearing 172 of a second scroll 150, respectively, so as to be rotatably coupled thereto. Accordingly, the rear end of the rotation shaft 125 is rotatably supported at the frame 130 and the second scroll 150 in a radial direction, while the front end becomes a free end in a coupled state to the rotor 122. Thus, the rotation shaft 125 is supported in a cantilevered manner.

The rotation shaft 125 is provided with an eccentric portion 125*d* formed on the main bearing portion 125*b* and the sub bearing portion 125*c* to be eccentric with respect to a shaft center, and the eccentric portion 125*d* is eccentrically coupled to a first scroll 140 to transfer the rotational force of the driving motor 120 to the first scroll 140. Accordingly, the first scroll 140 performs an orbiting motion.

An axial bearing protrusion 126 may extend radially from a middle portion of the rotation shaft 125, namely, between the main bearing portion 125*b* and the eccentric portion 125*d*. An axial bearing surface (not shown) of the axial bearing portion 126 forms a thrust surface together with an axial bearing surface (not shown) of a first shaft accommodating portion 131.

An oil supply passage 127 is formed in the rotation shaft 125 by a predetermined depth in a direction from the rear end toward the front end. Oil supply holes 127*a*, 127*b*, and 127*c* are formed through a middle portion of the oil supply passage 127 toward outer circumferential surfaces of the main bearing portion 125*b*, the eccentric portion 125*d*, and the sub bearing portion 125*c*, respectively.

In addition, the shaft portion 125*a* of the rotation shaft 125 may be formed in a circular rod shape. However, the shaft portion 125*a* of the rotation shaft 125 may be provided with a communication hole 128 for communicating the front space S11 with the rear space S12. The communication hole 128 allows the suction communication passage to be widened so that a refrigerant in the front space S11 can quickly flow to the rear space S12. For convenience, the communication hole 128 is defined as a communication passage portion constituting a part of the suction communication passage, which will be described later.

As illustrated in FIGS. 4 and 5, the main housing 110 may be formed in a cylindrical shape as described above. Accordingly, an inner circumferential surface of the main housing 110 may be formed in a round shape having the same radius from a center Om of the driving motor 120.

However, if an inner circumferential surface of the main housing 110 and an outer circumferential surface of the stator core 1211 are formed in a round shape, a gap is not generated between the inner circumferential surface of the main housing 110 and the outer circumferential surface of the stator core 1211. As a result, oil separated from a refrigerant may not smoothly flow from the front space S11, communicated with the inlet port 111, to the rear space S12 in the inner space of the main housing 110. Then, the oil is excessively accumulated in the front space S11 and oil shortage may occur in the compression unit 105.

Accordingly, a communication groove 112 recessed long by a predetermined depth near a rear end may be formed at the inner circumferential surface of the main housing 110 according to this embodiment. The communication groove 112 may be formed to have a length long enough that the front space S11 and the rear space S12 can communicate with each other so that oil in the front space S11 can move to the rear space S12. That is, the communication groove 112 is preferably formed at least longer than an axial length of the stator core 1211.

Since the communication groove 112 serves as a passage through which oil stored in the front space S11 can flow to the rear space S12, at least part of the communication groove 112 is preferably formed to be included in the lowest point of the main housing 110.

The communicating groove 112 may also be as wide as the oil can pass therethrough, but may preferably be as shallow in depth as possible in a radial direction, in view of increasing an outer diameter of the stator 121.

Since the communication groove 112 is recessed by a predetermined depth into the inner circumferential surface of the main housing 110, a protruding portion may be formed on the outer circumferential surface of the main housing 110 by the recessed depth of the communication groove 112, in order to secure a uniform thickness of the main housing 110. However, since a depth or width of the communicating groove 112 is not large, the communicating groove 112 may alternatively be formed shallowly on the inner circumferential surface of the main housing 110 without forming the protruding portion. Accordingly, an outer diameter of the main housing 110 at a portion where the communication groove 112 may also be the same as an outer diameter at the other portion.

However, an amount of oil separated from a refrigerant in the front space S11 is not large and the oil can flow toward the rear space S12 along the first communication passage 120*a* and the second communication passage 120*b* in a mixed state with a subsequently-sucked refrigerant.

On the other hand, the frame 130 is coupled to the rear end of the main housing 110. The frame 130 may have a disk shape and may be coupled to the rear end of the main housing 110 by bolts. Accordingly, the frame 130 may be formed in a round shape having the same radius except for coupling protrusions for coupling with the main housing 110.

However, as described above, since the frame 130 is coupled to or integrally formed with the rear side of the main housing 110, the frame 130 must be provided with a suction guide passage through which a refrigerant can pass. With this structure, a refrigerant that has moved from the front space S11 to the rear space S12 of the main housing 110 through the suction communication passage can be sucked into the compression unit 105. The suction guide passage will be described later with reference to FIG. 6.

Referring back to FIG. 2, with regard to the frame 130 according to this embodiment, a first shaft accommodating portion 131, through which the main bearing portion 125*b* of the rotation shaft 125 to be explained later is inserted so as to be rotatably supported, may protrude from the frame 130 toward the driving motor 120, a shaft accommodating hole may be formed at a center of the first shaft accommodating portion 131, such that a first bearing for supporting the main bearing portion 125*b* of the rotation shaft 125 is coupled thereto. In the drawing, the first bearing 171 is shown as a bush bearing, but it may alternatively be a ball bearing in some cases.

An inner circumferential surface of the first shaft accommodating portion 131 may be spaced apart from the main bearing portion 125*b* of the rotation shaft 125 so that a back pressure chamber S3 to be described later can communicate with the motor chamber S1. With this configuration, as oil or refrigerant in the back pressure chamber S3 flows toward the motor chamber S1 along the axial bearing surface, dynamic pressure is generated in the back pressure chamber S3.

Also, the frame 130 is provided at its rear side with a scroll receiving groove 132 in which an orbiting disk portion 141 of a first scroll 140 to be explained later is inserted to be supported in an axial direction, an Oldham ring accommodating groove 133 for accommodating an Oldham ring 180 therein which is a rotation-preventing mechanism, and a balance weight accommodating groove 134 successively stepped from a rear side to a front side to rotatably accommodate a balance weight 124 therein. Accordingly, the Oldham ring accommodating groove 133 and the balance weight accommodating groove 134 form the back pressure chamber S3.

On the other hand, a suction guide passage along which a refrigerant which has moved to the rear space of the motor chamber can be sucked into the compression chamber may be formed through an edge portion of the frame in an axial direction.

Figure 6:
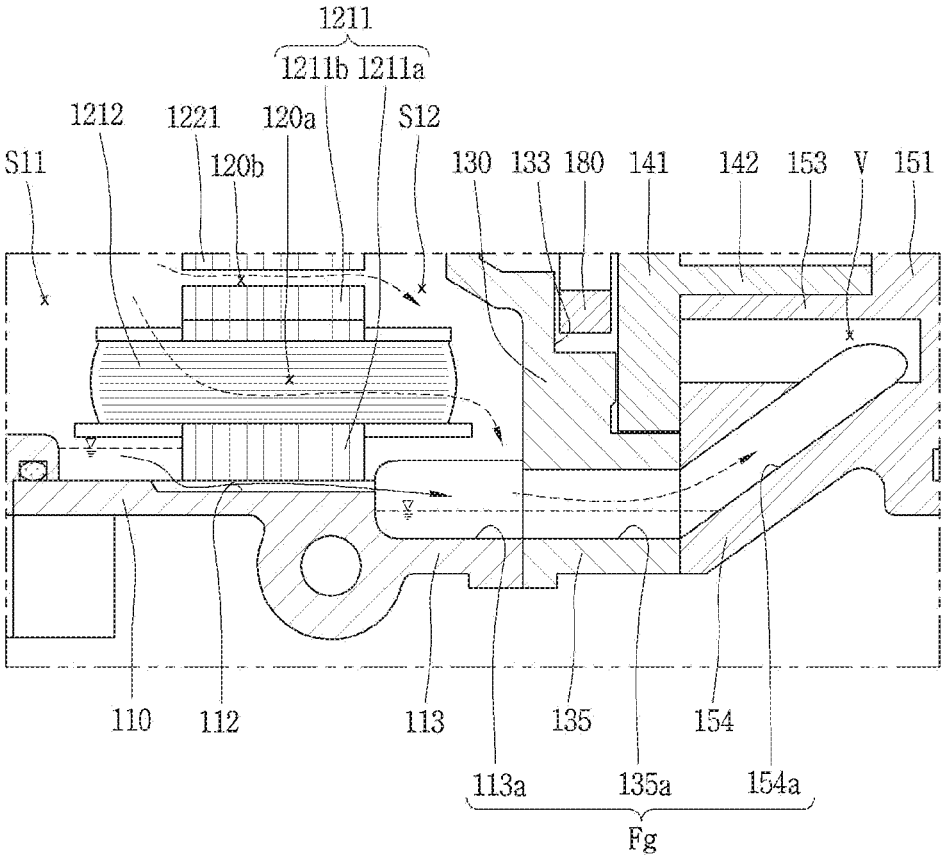
FIG. 6 is a sectional view of a suction guide passage for guiding a refrigerant of a motor chamber to a compression chamber in a motor-operated compressor according to an embodiment of the present disclosure.

FIG. 6 is a sectional view of a suction guide passage for guiding a refrigerant of a motor chamber to a compression chamber in a motor-operated compressor according to an embodiment of the present disclosure. As shown, the suction guide passage 135*a* may be formed at a lower half of the frame 130, that is, the lowest point of the frame 130.

For example, when the compressor module 101 is installed in a horizontal direction with respect to the ground, a protrusion 135 extending radially from the outer circumferential surface of the frame 130 is formed near the lowest point closest to the ground. The protrusion 135 is provided with a suction guide passage 135*a* formed therethrough in an axial direction. The suction guide passage 135*a* of the frame 130 is located between the suction guide passage 113*a* provided in the main housing 110 and a suction guide passage 154*a* provided in the second scroll 150, to guide a refrigerant within the rear space S12 toward the compression chamber (suction chamber) V.

Here, if the frame 130 is formed in a round shape having the same radius from the center Om of the motor, an outer diameter of the frame 130 increases as large as the suction guide passage being formed at the edge of the frame 130. As the outer diameter of the frame 130 increases, an outer diameter and weight of the compressor increases. This is disadvantageous in reducing a size and weight of the compressor. Therefore, it may be preferable to form a radially-extending protrusion in a partial section of the outer circumferential surface of the frame 130 and form a suction guide passage in the protrusion.

Accordingly, it is preferable that protrusions 113 and 154 are formed at an outer circumferential surface of the main housing 110 and an outer circumferential surface of the second scroll 150, respectively, and the suction guide passage 113*a* of the main housing 110 and the suction guide passage 154*a* of the second scroll 150, which communicate with the suction guide passage 135*a* of the frame 130, are formed in the protrusions 113 and 154, respectively. Hereinafter, according to a flow sequence of a refrigerant, the protrusion of the main housing 110 is defined as a first protrusion 113, a protrusion of the frame 130 is defined as a second protrusion 135, a protrusion of the second scroll 150 is defined as a third protrusion 154, a suction guide passage of the main housing 110 is defined as a first guide passage 113*a*, a suction guide passage of the frame 130 is defined as a second guide passage 135*a*, and a suction guide passage of the second scroll 150 is defined as a third guide passage 154*a*. The first, second, and third suction guide passages are collectively defined as a suction guide passage Fg.

On the other hand, the compression unit 105, as aforementioned, includes an orbiting scroll (hereinafter, referred to as a first scroll) 140 supported by the frame 130 in an axial direction to perform an orbiting motion, and a fixed scroll (or a non-orbiting scroll) (hereinafter, referred to as second scroll 150) engaged with the first scroll 140 and fixed to a rear end of the frame 130. A pair of compression chambers V is formed between the first scroll 140 and the second scroll 150 during the orbiting motion of the first scroll 140. The compression chamber will be described later with an orbiting wrap and a fixed wrap.

The first scroll 140 is axially supported by being inserted into a scroll mounting groove of the frame 130, and an Oldham ring 180 which is a rotation-preventing mechanism for preventing a rotation of the first scroll 140 is provided between the frame 130 and the first scroll 140. The Oldham ring 180 is inserted into an Oldham ring mounting groove 133 of the frame 130. The rotation-preventing mechanism may alternatively be implemented as a mechanism including a pin and a ring as well as the Oldham ring.

The first scroll 140 is provided with an orbiting scroll disk portion (hereinafter, referred to as an orbiting disk portion) 141 substantially in a disk shape. An orbiting wrap 142 is formed on a front surface of the orbiting disk portion 141. The orbiting wrap 142 is engaged with a fixed wrap 153 to be explained later so as to form compression chambers at an inner surface and an outer surface with respect to the fixed wrap 153. The orbiting wrap will be explained later with the fixed wrap.

The orbiting disk portion 141 is provided with a back pressure hole 141*a* for communicating the back pressure chamber S3 and an intermediate compression chamber V with each other. Accordingly, oil or refrigerant can flow between the back pressure chamber S3 and the intermediate compression chamber V according to a difference between pressure in the back pressure chamber S3 and pressure in the intermediate compression chamber V.

A rotation shaft coupling portion 143 to which the eccentric portion 125*d* of the rotation shaft 125 is rotatably coupled is formed through a center of the orbiting disk portion 141. The rotation shaft coupling portion 143 is formed in a cylindrical shape, and a third bearing 173 forming a bearing surface together with the eccentric portion 125*d* of the rotation shaft 125 is inserted into the rotation shaft coupling portion 143. The rotation shaft coupling portion 143 (or the third bearing) is formed to overlap the orbiting wrap 142 in a radial direction. The rotation shaft coupling portion 143 becomes a portion of the orbiting wrap 142 which is located at the innermost position.

Meanwhile, the second scroll 150, as aforementioned, is coupled to the rear end of the frame 130 from the outside of the main housing 110. In this case, a sealing member such as a gasket may be provided between the frame 130 and the second scroll 150.

The second scroll 150 includes a fixed scroll disk portion (hereinafter, referred to as a fixed disk portion) 151 formed substantially in a disk shape, and a side wall portion 152 formed at an edge of the fixed disk portion 151 to be coupled to a frame-side end of the main housing 110.

A fixed wrap 153 which is engaged with the orbiting wrap 142 to form compression chambers is formed on a front surface of the fixed disk portion 151. The fixed wrap 153 may be formed in an involute shape together with the orbiting wrap 142, but may also be formed in various other shapes. The shape of the fixed wrap 153 will be described later together with the orbiting wrap 142, with reference to FIG. 7.

The third protrusion 154 radially protrudes from an outer circumferential surface of the side wall portion 152 so as to correspond to the second protrusion 135 of the frame 130. The third protrusion 154 may be provided therein with the third guide passage 154*a* communicating with the second guide passage 135*a*. Accordingly, the suction guide passage Fg is constituted as the first guide passage 113*a* of the main housing 110, the second guide passage 135*a* of the frame 130, and the third guide passage 154*a* of the second scroll 150 communicate together.

The third guide passage 154*a* constituting the suction guide passage Fg may be formed in an axial direction or may be formed to be inclined as shown in FIG. 6. If the third guide passage 154*a* is formed in the axial direction, an outer diameter of the fixed disk portion 151 may be enlarged to increase a wound length of the fixed wrap 153, compared to the same outer diameter of the main housing 110. On the other hand, if the third guide passage 154*a* is formed to be inclined, the wound length of the fixed wrap 153 compared with the same capacity of the compression chamber may be reduced so as to downsize the compressor.

As the first guide passage 113*a*, the second guide passage 135*a* and the third guide passage 154*a* constituting the suction guide passage Fg are formed in the first protrusion 113, the second protrusion 135 and the third protrusion 154, the suction guide passage Fg may be formed close to an outer circumferential surface of the compressor. Accordingly, a refrigerant sucked into the compression chamber V through the suction guide passage Fg from the motor chamber S1 can quickly exchange heat with external air of the compressor, which may lower a specific volume of the refrigerant sucked into the compression chamber V, thereby reducing a suction loss. Particularly, since the frame 130 and the second scroll 150 are provided outside the main housing 110, the second and third guide passages 135*a* and 154*a* can be located much closer to the outside than being inserted into the main housing 110. Accordingly, a refrigerant which has been slightly heated while passing through the motor chamber can be effectively cooled.

Further, a dimple groove 152*a* may be formed on the outer circumferential surface of the side wall portion 152 to reduce a weight of the second scroll 150 and simultaneously prevent deformation of the second scroll 150. A plurality of dimple grooves 152*a* may be provided along a circumferential direction and spaced at predetermined intervals, or one continuous dimple groove 152*a* may be formed in the circumferential direction.

Since the outer circumferential surface of the side wall portion 152 of the second scroll 150 is located outside the main housing 110, an outer diameter of the second scroll 150 may be greater than or equal to an inner diameter of the main housing 110 or the frame 130. Therefore, the outer diameter of the second scroll 150 can increase on the basis of the same outer diameter of the compressor, which may result in extending the wound lengths of the fixed wrap 153 and the orbiting wrap 142, thereby increasing a suction volume of the compression chamber V.

Figure 7:
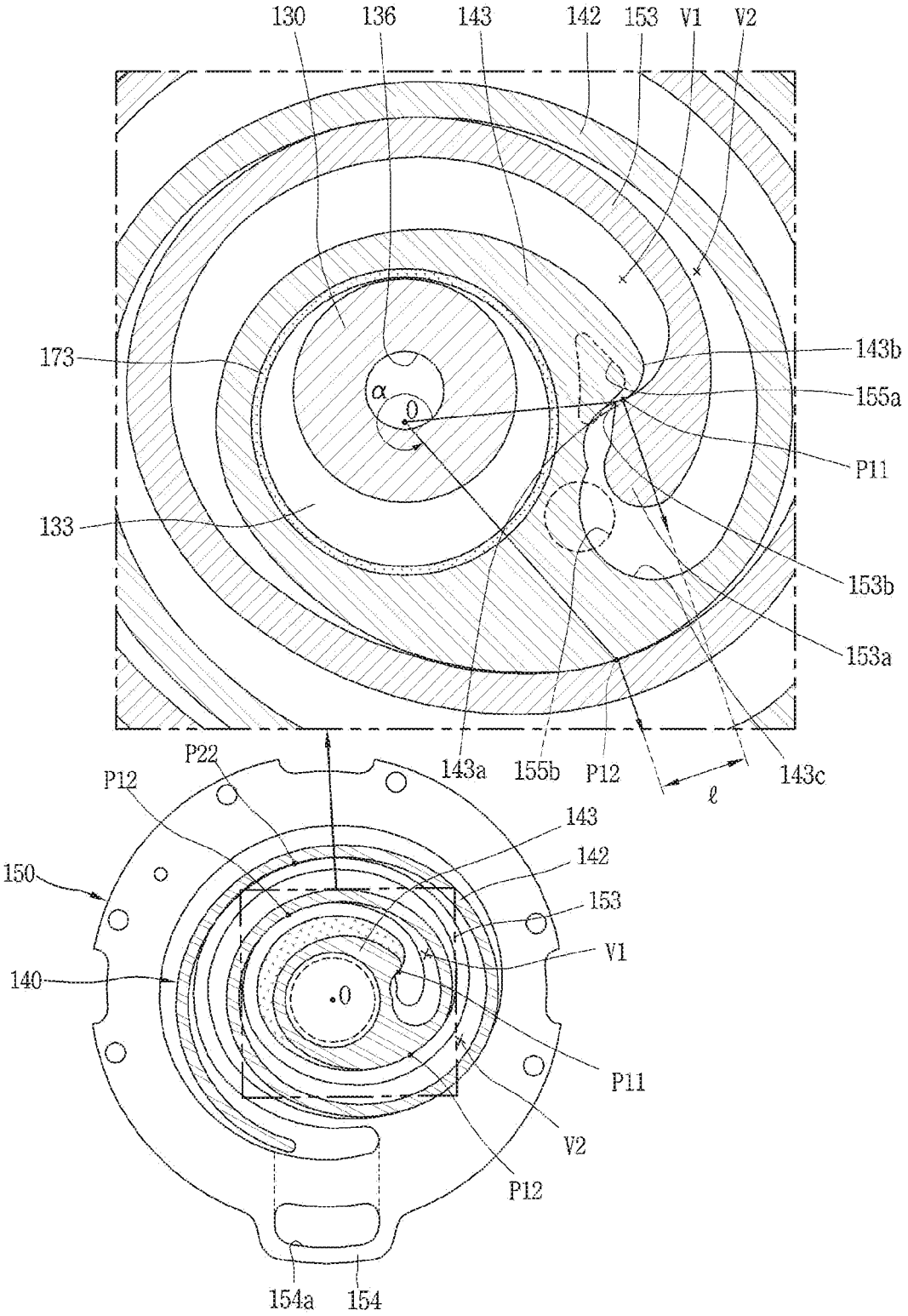
FIG. 7 is a planar view illustrating an engagement relationship between an orbiting wrap and a fixed wrap in a non-involute shape in a motor-operated compressor according to an embodiment of the present disclosure.

An outlet port 155 which communicates a final compression chamber V with a discharge chamber S2 to be explained later so as to guide a discharge of a refrigerant is formed at a central part of the fixed disk portion 151. The outlet port 155 may be formed in a penetrating manner from the compression chamber V to the discharge chamber S2 in an axial direction or inclined direction of the fixed disk portion 151. As illustrated in FIG. 7, only one outlet port 155 may be formed to communicate a first compression chamber V1 and a second compression chamber V2 to be explained later, or a first outlet port 155*a* and a second outlet port 155*b* may be formed to communicate with the first compression chamber V1 and the second compression chamber V2, respectively.

A second shaft accommodating portion 156 in which the sub bearing portion 125*c* of the rotation shaft 125 is rotatably inserted to be supported in a radial direction is formed in the center of the fixed disk portion 151. The second shaft accommodating portion 156 may be formed in the fixed disk portion 151 in a manner of extending toward a rear housing 160 in an axial direction, or may be formed by increasing a thickness of the fixed disk portion 151. However, in the latter case, not only a weight of the second scroll 150 is increased but also an unnecessary portion is thickly formed, and thereby a length of the outlet port 155 may become long, thereby increasing a dead volume. Therefore, a part of the fixed disk portion 151 protrudes as shown in the former case. For example, it is preferable that a fourth protrusion 157 is formed at a portion of the fixed disk portion 151, except for the portion where the outlet port 155 is formed, in a manner of protruding in an axial direction and the second shaft accommodating portion 156 is formed in the fourth protrusion 157.

The second shaft accommodating portion 156 is formed in a cylindrical shape having a closed rear surface, and a second bearing 172, which forms a bearing surface together with the sub bearing portion 125*c* of the rotation shaft 125, is coupled to an inner circumferential surface of the second shaft accommodating portion 156 in an inserted manner. The second bearing 172 may be implemented as a bush bearing or a needle bearing.

An oil guide space 156*a* more extending in the axial direction than an end portion of the rotation shaft 125 is formed in a rear side of the second shaft accommodating portion 156. The oil guide space 156*a* is located between an oil guide passage 157*a* and an oil supply passage 127 to be explained later. The oil guide passage 157*a* may communicate with the discharge chamber S2, and the oil supply passage 127 may communicate the bearing surfaces provided on the outer circumferential surfaces of the main bearing portion 125*b*, the sub bearing portion 125*c* and the eccentric portion 125*d*, respectively.

The oil guide passage 157*a* may be formed in the second scroll 150 or in the rear housing 160, which will be described later. One end of the oil guide passage 157*a* may communicate with an outer circumferential surface of the fixed disk portion 151 and another end of the oil guide passage 157*a* may communicate with an inner circumferential surface of the oil guide space 156*a*. Accordingly, oil of high pressure, separated from a refrigerant in the discharge chamber S2 of the rear housing 160, can quickly flow to the oil guide space 156*a* along the oil guide passage 157*a* by a pressure difference, and then may be quickly supplied to each bearing surface through the oil supply passage 127 and the respective oil supply holes 127*a* to 127*c* by the pressure difference.

On the other hand, each of the orbiting wrap and the fixed wrap may be formed in an involute shape. However, as shown in this embodiment, when the rotation shaft is coupled through the center of the second scroll as the orbiting scroll, the final compression chamber may be formed in an eccentric position, and thereby a great pressure difference may be generated between the compression chambers. This is because, in case of a shaft-through scroll compressor, pressure of one compression chamber becomes much lower than pressure of another compression chamber as the final compression chamber is formed eccentrically from a center of a scroll. Therefore, in the shaft-through scroll compressor, it is advantageous to form the orbiting wrap and the fixed wrap into a non-involute shape as shown in this embodiment.

FIG. 7 is a planar view illustrating an engagement relationship between an orbiting wrap and a fixed wrap in a non-involute shape in a motor-operated compressor according to an embodiment of the present disclosure.

As illustrated in FIG. 7, an orbiting wrap 142 according the embodiment of the present disclosure may have a shape in which a plurality of arcs having different diameters and origins are connected and the outermost curve is formed substantially in an elliptical shape having a major axis and a minor axis. A fixed wrap 153 may be formed in a similar manner.

A rotation shaft coupling portion 143 which forms an inner end portion of the orbiting wrap 142 and to which an eccentric portion 125*d* of a rotation shaft 125 is rotatably inserted may be formed through a central part of an orbiting disk portion 141 in an axial direction. A third bearing 173 implemented as a bush bearing may be fixedly inserted into an inner circumferential surface of the rotation shaft coupling portion 143. An outer circumferential part of the rotation shaft coupling portion 143 is connected to the orbiting wrap 142 to form the compression chamber V together with the fixed wrap 153 during a compression process.

Furthermore, the rotation shaft coupling portion 143 may be formed at a height overlapping the orbiting wrap 142 on the same plane, and thus the eccentric portion 125*d* of the rotation shaft 125 may be disposed at a height overlapping the orbiting wrap 142 on the same plane. Accordingly, a repulsive force and a compressive force of a refrigerant can be attenuated by each other while being applied to the same plane based on an orbiting disk portion, thereby preventing an inclination of the first scroll 140 due to an action of the compressive force and repulsive force.

The rotation shaft coupling portion 143 is provided with a concave portion 143*a* formed on an outer circumferential part thereof, which faces an inner end portion of the fixed wrap 153, and engaged with a protrusion 153*a* of the fixed wrap 153 to be explained later. An increasing portion 143*b* which increases in thickness from an inner circumferential part to the outer circumferential part of the rotation shaft coupling portion 143 is formed at an upstream side along a direction that a compression chamber V is formed. This may extend a compression path of the first compression chamber V1 immediately before discharge, and consequently a compression ratio of a first compression chamber V1 can be increased close to a compression ratio of a second compression chamber V2.

At another side of the concave portion 335 is formed an arcuate compression surface 143*c* having an arcuate shape. A diameter of the arcuate compression surface 143*c* is decided by a thickness of the inner end portion of the fixed wrap 153 (i.e., a thickness of a discharge end) and an orbiting radius of the orbiting wrap 142. When the thickness of the inner end portion of the fixed wrap 153 increases, a diameter of the arcuate compression surface 143*c* increases. As a result, a thickness of the orbiting wrap around the arcuate compression surface 143*c* may increase to ensure durability, and the compression path may extend to increase the compression ratio of the second compression chamber V2 to that extent.

In addition, a protrusion 153*a* is formed near the inner end portion (a suction end or a start end) of the fixed wrap 153 corresponding to the rotation shaft coupling portion 143 in a manner of protruding toward the outer circumferential part of the rotation shaft coupling portion 143. The protrusion 153*a* may be provided with a contact portion 153*b* protruding therefrom to be engaged with the concave portion 143*a*. In other words, the inner end portion of the fixed wrap 153 may be formed to have a larger thickness than other portions. As a result, wrap strength at the inner end portion of the fixed wrap 153, which is subjected to the highest compressive force, may increase so as to enhance durability.

On the other hand, the compression chamber V may be formed by the fixed disk portion 151, the fixed wrap 153, the orbiting wrap 142 and the orbiting disk portion 141, and a suction chamber, an intermediate pressure chamber, and a discharge chamber may be formed consecutively along a proceeding direction of the wraps.

The compression chamber V may include a first compression chamber V1 formed between an outer surface of the orbiting wrap 142 and an inner surface of the fixed wrap 153, and a second compression chamber V2 formed between an inner surface of the orbiting wrap 152 and an outer surface of the fixed wrap 153. In other words, the first compression chamber V1 includes a compression chamber formed between two contact points P11 and P12 generated in response to the inner surface of the fixed wrap 153 being brought into contact with the outer surface of the orbiting wrap 142, and the second compression chamber V2 includes a compression chamber formed between two contact points P21 and P22 generated in response to the outer surface of the fixed wrap 153 being brought into contact with the inner surface of the orbiting wrap 142.

Here, when a large angle of angles formed between two lines, which connect a center of the eccentric portion, namely, a center O of the rotation shaft coupling portion to the two contact points P11 and P12, respectively, is defined as a within the first compression chamber V2 just before discharge, the angle $\alpha$ at least just before the discharge is larger than 360° (i.e., $\alpha<360°$), and a distance l between normal vectors at the two contact points P11, P12 has a value greater than zero.

As a result, the first compression chamber immediately before the discharge, which is formed by the fixed wrap and the orbiting wrap according to the embodiment of the present disclosure, may have a smaller volume than that formed by a fixed wrap and an orbiting wrap having an involute shape. Therefore, the compression ratios of the first and second compression chambers V1 and V2 can all be improved even without increasing the size of the first wrap 142 and the second wrap 153.

Meanwhile, a rear housing 160 is coupled to a rear surface of the second scroll 150. As the rear housing 160 is coupled to the rear surface of the second scroll 150, a discharge chamber S2 may be formed such that a refrigerant discharged from the compression chamber V is accommodated therein. A sealing member such as a gasket may be provided between the rear housing 160 and the second scroll 150.

The rear housing 160 is provided with an exhaust port 161 communicating with a discharge pipe. The rear housing 160 may also be provided therein with a support protrusion 162 protruding toward a fourth protrusion 157 of the second scroll 150 so as to support the second scroll 150 in an axial direction. The support protrusion 162 is in close contact with a rear surface of the second scroll 150, more precisely, the fourth protrusion 157 so as to support the second scroll 150 toward the first scroll 140.

Meanwhile, an inverter housing 210 may be coupled in a covering manner to one of both ends of the main housing 110, which is opposite to the rear housing 160, namely, the front end of the main housing 110.

Referring back to FIGS. 1 and 2, the inverter housing 210 constitutes a part of an inverter module 201. The inverter housing 210 forms an inverter chamber S4 together with an inverter cover 220.

The inverter chamber S4 accommodates therein inverter components 230 such as a substrate and an inverter element, and the inverter housing 210 and the inverter cover 220 are coupled to each other by bolts. The inverter cover 220 may be assembled to the inverter housing 210 after the inverter housing 210 is first assembled to the main housing 110, or the inverter housing 210 may be assembled to the main housing 110 after being assembled to the inverter cover 220. The former and the latter may differ according to a method of assembling the inverter housing 210 to the main housing 110.

A sealing surface portion 212 facing the front end of the main housing 110 may be formed on a rear surface of the inverter housing 210 and a sealing protrusion 213 is formed at an inner side of the sealing surface portion 212 to be inserted into an inner circumferential surface of the main housing 110. An O-ring serving as a sealing member 215 may be inserted between an outer circumferential surface of the sealing protrusion 213 and an inner circumferential surface of an opening of the main housing 110 which are in contact with each other.

The sealing protrusion 213 may be formed in an annular shape and have a predetermined height and thickness within a range that does not interfere with the driving motor 120. A sealing groove 213*a* in which the O-ring as the sealing member 215 is inserted may be formed on the outer circumferential surface of the sealing protrusion 213. The sealing groove 213*a* may also be formed on the inner circumferential surface of the main housing 110. However, when the sealing member 215 is the O-ring, it is advantageous in terms of assembly characteristics that the sealing member 215 is inserted onto an outer surface of the sealing protrusion 213.

In the drawings, unexplained reference numerals 115 and 211 denote coupling protrusions.

Oil and refrigerant may circulate in the motor-operated compressor according to the embodiment of the present disclosure as follows.

That is, when power is applied to the driving motor 120, the rotation shaft 125 transfers a rotational force to the first scroll 140 while rotating together with the rotor 122, and the first scroll 140 performs an orbiting motion by the Oldham ring 180. Then, the compression chamber V is reduced in volume while continuously moving toward a center.

The refrigerant then flows into the motor chamber S1 as a suction space through the inlet port 111. The refrigerant introduced into the motor chamber S1 mainly flows from the front space S11 to the rear space S12 through the first communication passage 120*a* and the second communication passage 120*b*. At this time, the refrigerant flowing from the front space S11 to the rear space S12 absorbs heat generated by the driving motor 120, so as to cool the driving motor 120.

On the other hand, the refrigerant moved to the rear space S12 is sucked into the compression chamber V through the guide passages 113*a*, 135*a* and 154*a*. At this time, oil sucked into the front space S11 together with the refrigerant is separated from the refrigerant in the front space S11 and is gathered on a bottom surface of the front space S11. The oil then flows from the front space S11 to the rear space S12 through the communication groove 212 provided at the bottom surface of the main housing 110 so as to be sucked into the compression chamber V together with the refrigerant.

The refrigerant is compressed by the first scroll 140 and the second scroll 150 and discharged to the discharge chamber S2 through the outlet port 155. This refrigerant is separated from oil in the discharge chamber S2. The refrigerant is discharged to a refrigeration cycle through the exhaust port 161 while the oil is supplied to each bearing surface through the oil guide passage 157*a*, the oil guide space 156*a*, the oil supply passage 127 and the oil supply holes 127*a* to 137*c* which constitute an oil supply path. The oil is partially introduced into the back pressure chamber S3 so as to form back pressure supporting the first scroll 140 toward the second scroll 150.

The first scroll 140 is supported in a direction toward the second scroll 150 by the back pressure of the back pressure chamber S3, so that the compression chamber V between the first scroll 140 and the second scroll 150 is sealed. At this time, the oil in the back pressure chamber S3 partially flows into the compression chamber V through the back pressure hole 141*a* provided at the orbiting disk portion 141 while partially being introduced into the motor chamber S1 through a gap between the main bearing portion 125*b* and the first bearing 171 such that the back pressure chamber S3 forms dynamic pressure. Such series of processes are repetitively performed.

As described above, in the motor-operated compressor according to the embodiment, the suction communication passage is not formed between the inner circumferential surface of the main housing 110 and the outer circumferential surface of the stator core 1211, or is formed very narrowly even when formed. Accordingly, most of the refrigerant introduced into the front space S11 through the inlet port 111 flow to the rear space S12 through the first communication passage 120*a* formed in the stator 121 and the second communication passage 120*b* formed between the stator 121 and the rotor 122.

At this time, as the coils 1212 according to the embodiment are wound in the concentrated winding manner, an interval between the neighboring coils becomes wider than that of a distributed winding. Therefore, an entire area of the first communication passage 120*a* formed between the neighboring coils is enlarged, so that the refrigerant in the front space S11 can quickly flow to the rear space S12 through the first communication passage 120*a* although a separate suction communication passage is not formed between the main housing 110 and the stator 121.

Also, an outer diameter of the stator 121 can increase because the suction communication passage is not formed at the outer circumferential surface of the stator 121. Accordingly, the inner diameter of the stator 121 and the outer diameter of the rotor 122 can increase, which may result in enlarging an entire area of the second communication passage 120*b* formed between the outer circumferential surface of the stator 121 and the inner circumferential surface of the rotor 122. As a result, the refrigerant in the front space S11 can smoothly flow to the rear space S12 through the second communication passage 120*b*.

However, in some cases, the refrigerant in the front space S11 may not be able to quickly move to the rear space S12 only through the first communication passage 120*a* and the second communication passage 120*b*. Then, an amount of refrigerant sucked into the compression chamber V becomes insufficient, and performance of the compressor may be deteriorated due to a suction loss.

Accordingly, a communication passage portion for communicating the front space and the rear space may be formed inside the rotation shaft according to the embodiment of the present disclosure. The communication passage portion forms a third communication passage constituting the suction communication passage.

Figure 8:
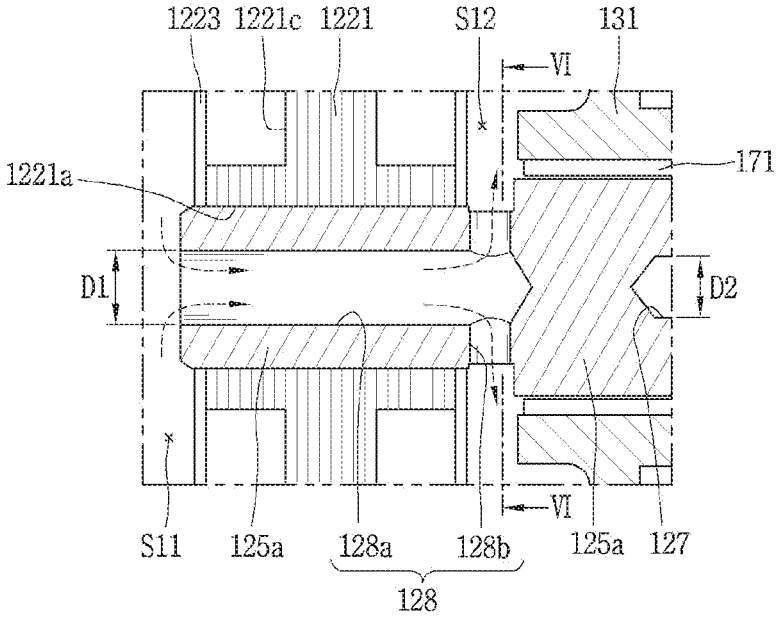
FIG. 8 is a sectional view illustrating a part of a rotation shaft for explaining a communication hole in the rotation shaft according to the present disclosure.
Figure 9:
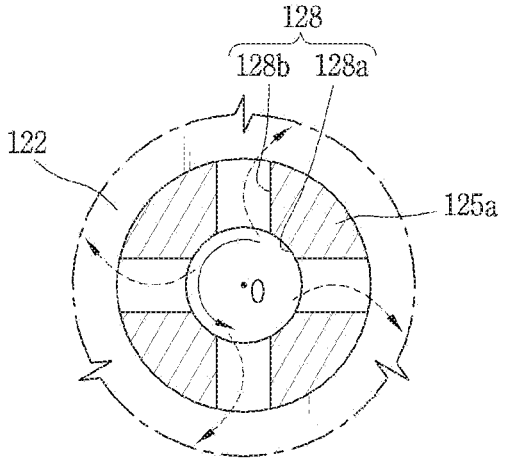
FIG. 9 is a sectional view taken along the line "VI-VI" for explaining a second communication hole in FIG. 8.

FIG. 8 is a sectional view illustrating a part of a rotation shaft for explaining a communication hole in the rotation shaft according to the present disclosure, and FIG. 9 is a sectional view taken along the line "VI-VI" for explaining a second communication hole in FIG. 8.

As illustrated in FIGS. 8 and 9, a communication passage portion may be implemented as a communication hole formed through the rotation shaft 125. The communication hole 128 may include a first communicating hole 128*a* formed in an axial direction and a second communicating hole 128*b* communicating with the first communicating hole and formed in a radial direction.

The first communication hole 128*a* is formed by a predetermined depth in a direction from a front end to a rear end of the rotation shaft 125. The first communication hole 128*a* has one end accommodated in the front space S11 and another end accommodated in the rear space S12.

An inner diameter of the first communication hole 128*a* is preferably formed as wide as possible so that the shaft portion 125*a* of the rotation shaft 125 can support the rotor 122, in view of a flow rate of a refrigerant. For example, an inner diameter D1 of the first communication hole 128*a* may be formed to be equal to or greater than an inner diameter D2 of the oil supply passage 127.

The second communication hole 128*b* may be formed in a penetrating manner from an inner circumferential surface of the first communication hole 128*a* to an outer circumferential surface of the rotation shaft 125. The second communication hole 128*b* may be formed to communicate with the another end of the first communication hole 128*a*, that is, the rear space S12.

Here, only one second communication hole 128*b* may be formed. However, as illustrated in FIG. 9, the second communication hole 128*b* may be provided in plurality, and the plurality of second communication holes 128*b* may be formed at predetermined intervals along a circumferential direction. When the plurality of second communication holes 128*b* are formed along the circumferential direction, a refrigerant can flow more quickly.

The second communication hole 128*b* may be formed at a position where its outlet end overlaps the coil 1212 located in the rear space S12 in a radial direction. Accordingly, a refrigerant flowing from the front space S11 to the rear space S12 through the communication hole 128 may be radially sprayed from the second communication hole 128*b* and then brought into contact with the coil 1212, thereby effectively cooling the coil 1212. At this time, the refrigerant can more quickly flow as a centrifugal force is generated by the second communication hole 128*b*.

On the other hand, since the first communication hole is formed in the axial direction, there is a limit to increase a suction force for a refrigerant. Therefore, the inner circumferential surface of the first communication hole 128*a* may be formed in a flat smooth tube shape, but a suction guide groove (not shown) may be formed in a spiral shape. Then, the spiral suction guide groove generates a centrifugal force, so that the refrigerant in the front space S11 can move to the rear space S12 more quickly.

Figure 10:
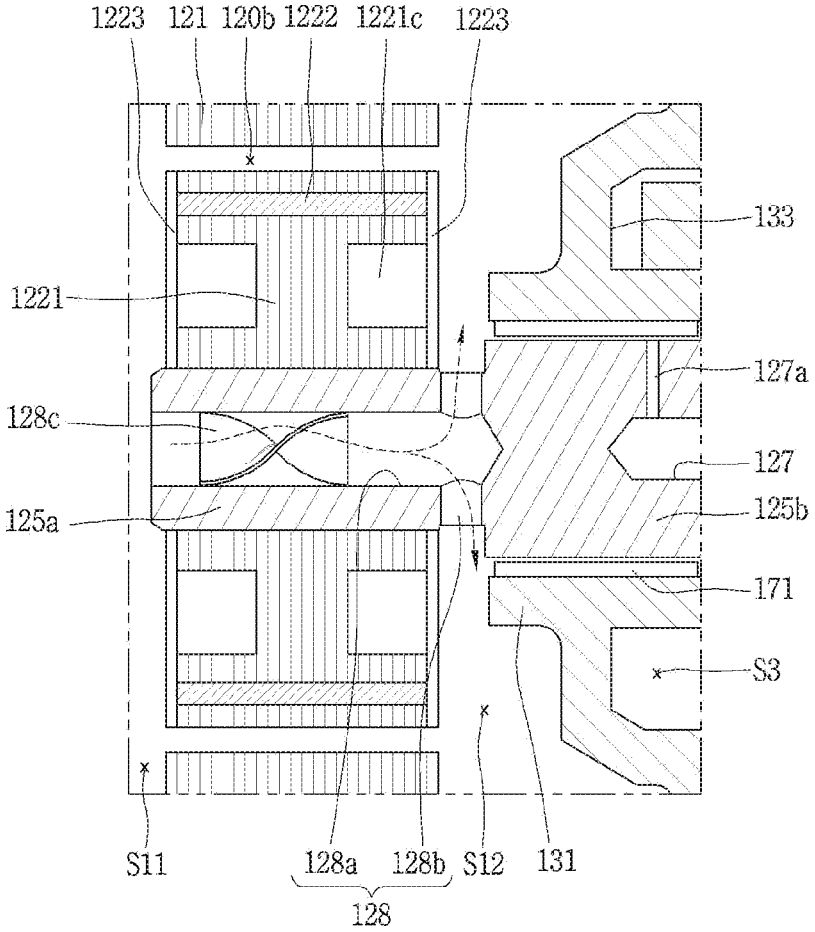
FIG. 10 is a sectional view illustrating an example in which a communication hole is provided with a suction guiding member in FIG. 8.

Also, as illustrated in FIG. 10, a suction guide member 128*c* for facilitating a suction of a refrigerant may be provided in the first communication hole 128*a*. The suction guide member 128*c* according to this embodiment may be a helical fan.

Thus, in the motor-operated compressor according to the embodiment of the present disclosure, the inner circumferential surface of the main housing and the outer circumferential surface of the stator core all come into tight contact with each other, or almost all except for the communication groove are closely contacted.

Accordingly, during a process of fixing the stator core to the main housing by press-fitting, the stator core uniformly receives substantially the same radial force from the main housing along a circumferential direction. Then, stress on the outer circumferential surface of the stator core is generated substantially uniformly along the circumferential direction, and thus the stator core can be maintained substantially in a round shape without being deformed. Then, almost the same gap is maintained between the stator and the rotor along the circumferential direction, thereby improving motor efficiency and simultaneously reducing a frictional loss between the stator and the rotor. Furthermore, collision noise between the stator and the rotor and vibration due to the collision noise can be suppressed.

In the motor-operated compressor according to the embodiment of the present disclosure, since the suction communication passage for passing a refrigerant therethrough is not formed between the main housing and the stator, an outer diameter of the stator can be maximized. Accordingly, an output of the motor can increase with respect to the same axial length, and also a size of the compressor can be reduced by decreasing the axial length of the motor with respect to the same output.

In the motor-operated compressor according to the embodiment of the present disclosure, since the suction communication passage is not formed between the main housing and the stator, a refrigerant sucked into the front space of the motor chamber may not move quickly to the rear space. However, as shown in the embodiment of the present disclosure, since the communication hole communicating the front space and the rear space is formed inside the rotation shaft, the refrigerant can move quickly from the front space to the rear space even if a separate suction communication path is not formed between the main housing and the stator. Accordingly, a suction loss of the compressor can be suppressed, and volume efficiency of the compressor can be enhanced.

In the foregoing embodiment, the communication hole formed through the rotation shaft is formed to communicate the front space and the rear space with each other. On the other hand, this embodiment illustrates that a communication passage groove is formed at an outer circumferential surface of the rotation shaft such that the front space and the rear space can communicate with each other. For convenience, a communication hole or communication passage groove provided in the rotation shaft is defined as a third communication passage.

Figure 11:
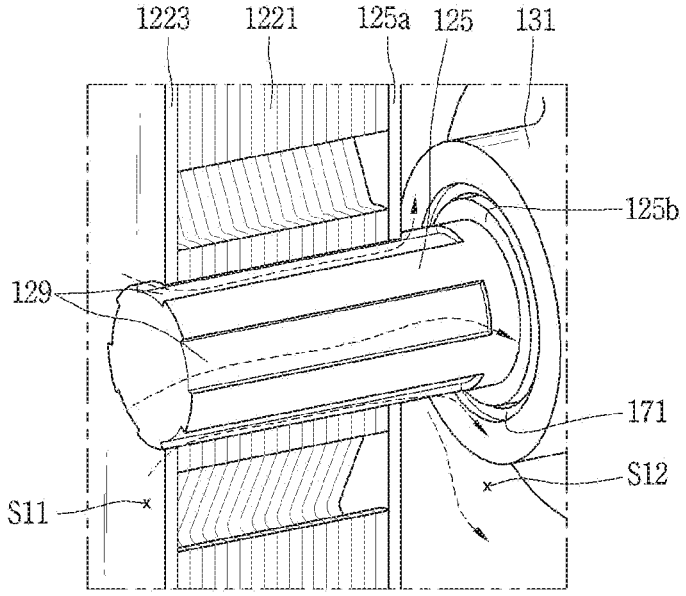
FIGS. 11 and 12 are perspective views illustrating different embodiments of a communication passage portion in a motor-operated compressor according to the present disclosure.
Figure 12:
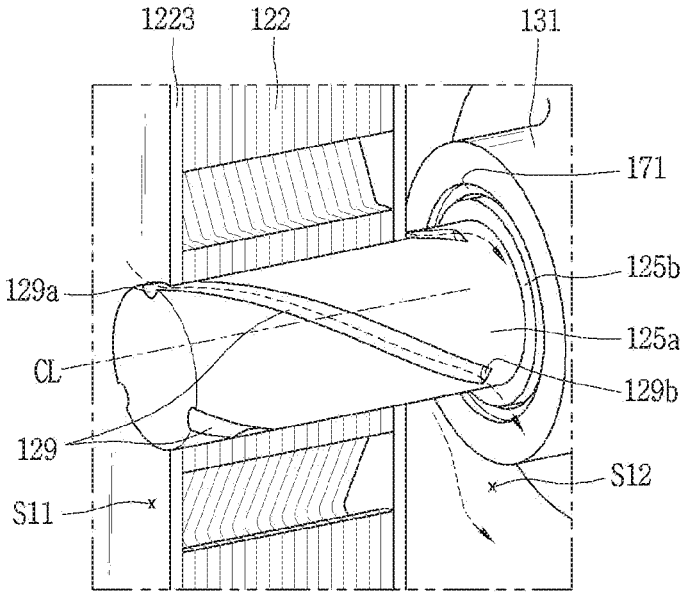

FIGS. 11 and 12 are perspective views illustrating different embodiments of a communication passage portion in a motor-operated compressor according to the present disclosure. As illustrated in these drawings, a communication passage portion according to this embodiment may be configured as a communication passage groove 129 formed to have a predetermined depth and width on the outer circumferential surface of the rotation shaft.

For example, the communication passage groove 129 is formed on the outer circumferential surface of the shaft portion 125*a*. The communication passage groove 129 is longer than an axial length of the rotor 122. Thus, an inlet end of the communication passage groove 129 is located in the front space S11 and an outlet end is located in the rear space S12, respectively.

The communication passage groove 129 may be formed in a linear shape along an axial direction as illustrated in FIG. 11, or may be formed into a spiral shape as illustrated in FIG. 12. When the communication passage groove 129 is formed in a spiral shape, it may be preferable that the communication passage groove 129 is wound in a forward direction with respect to a rotation direction of the rotation shaft 125. That is, on the basis of a middle portion of the communication passage groove 129, a first end 129*a* located in the front space S11 may be located at a forward side and a second end 129*b* located in the rear space S12 may be located at a backward side, with respect to the rotation direction of the rotation shaft 125. As a result, a centrifugal force in the communication passage groove 129 can increase and a refrigerant in the front space S11 can more quickly move to the rear space S12.

Further, only one communication passage groove 129 may be formed, but a plurality of communication passage grooves 129 may be formed in the same shape. When the communication passage groove is provided in plurality, each communication passage groove 129 can be formed small in depth or width, which may result in securing support strength of the rotation shaft 125 with respect to the rotor even while forming the communication passage grooves on the outer circumferential surface of the rotation shaft.

Since the operation effects of the communication passage groove according to this embodiment are the same as or similar to those of the aforementioned communication hole, a detailed description thereof will be omitted. However, in this embodiment, since the communication passage groove 129 is formed on the outer circumferential surface of the rotation shaft 125, it can be processed more easily than the communication hole.

Although not shown in the drawing, the communication passage groove may alternatively be formed on an inner circumferential surface of the shaft hole of the rotor in addition to the outer circumferential surface of the rotation shaft. The operation and effect thereof will be the same as or similar to that of the foregoing embodiment.

Meanwhile, in the above-described embodiment, the inlet port is formed through a side surface of the main housing. Alternatively, the inlet port may be formed through a front surface of the main housing, for example, a central portion of the inverter housing.

Figure 13:
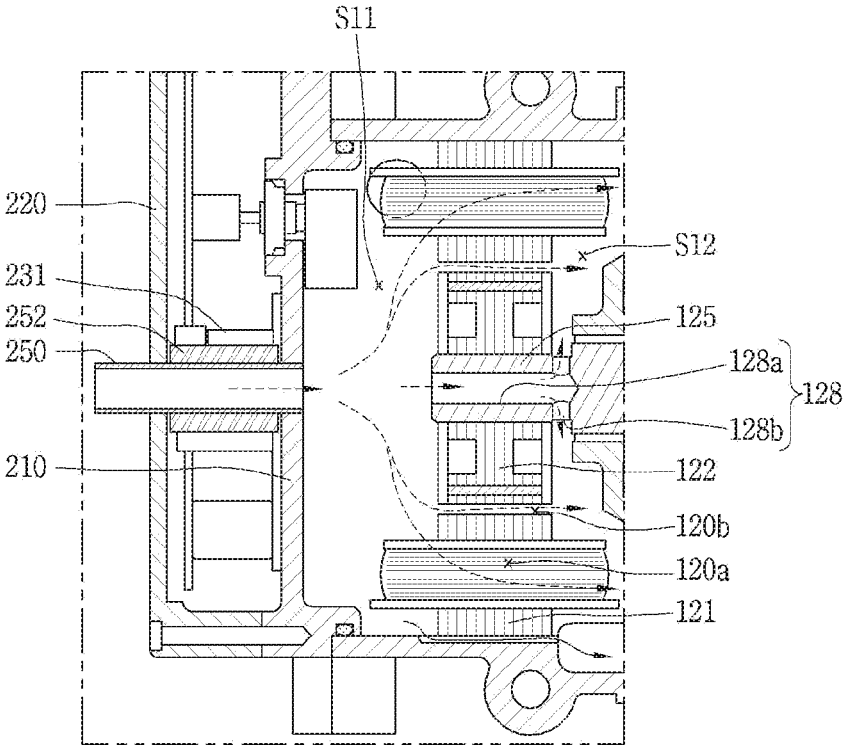
FIG. 13 is a sectional view illustrating another embodiment of a motor-operated compressor according to the present disclosure.

FIG. 13 is a sectional view illustrating another embodiment of a motor-operated compressor according to the present disclosure.

As illustrated in FIG. 13, the inverter module 201 may be provided with a suction guide pipe 250 axially coupled thereto in a penetrating manner, and one end of the suction guide pipe 250 may penetrate through the inverter housing 210 so as to communicate with the front space S11 of the main housing 110.

Furthermore, the suction guide pipe 250 may be provided with a device mounting portion 252, and an inverter device 231 such as a switching device may be adhered to an outer surface of the device mounting portion 252. Accordingly, the inverter device 231 can be quickly dissipated or cooled by a refrigerant sucked through the suction guide pipe 250, thereby improving the performance of the compressor.

In this case as well, the suction communication passage and the suction guide passage described in the foregoing embodiments may be provided. The basic structure and operation effects thereof are the same as or similar to those of the foregoing embodiments, and thus a detailed description thereof will be omitted.

When the suction guide pipe 250 communicates with the main housing 110 in an axial direction, the suction guide pipe 250 is preferably formed coaxially with the communication hole 128 of the rotation shaft 125, in view of simplifying a suction path of a refrigerant. That is, a refrigerant sucked into the front space S11 through the suction guide pipe 250 can flow more quickly to the rear space S12 through the communication hole 128 of the rotation shaft 125 positioned on a line. Of course, in this case as well, some of the refrigerant also flow from the front space S11 to the rear space S12 even through the first communication passage 120*a* provided in the stator and the second communication passage 120*b* between the stator and the rotor.

On the other hand, in the foregoing embodiments, the suction guide passage through which a refrigerant passes is not formed, except the communication groove, between the inner circumferential surface of the main housing and the outer circumferential surface of the stator core. However, in some cases, a suction guide passage through which a refrigerant flows, as well as the communication groove, may also be formed in a minimum size. Even in this case, an area of the suction guide passage can be remarkably reduced compared with the prior art, and thus the aforementioned effects can be obtained.

The foregoing embodiments are merely illustrative to practice the rotary compressor according to the present disclosure. Therefore, the present disclosure is not limited to the above-described embodiments, and it will be understood by those of ordinary skill in the art that various changes in form and details may be made therein without departing from the scope of the present disclosure.

What is claimed is:

1. A motor-operated compressor, comprising:

a compression unit including a compression chamber formed by a plurality of scrolls engaged with each other;

a rotation shaft having one end coupled to one of the plurality of scrolls;

a rotor coupled with another end of the rotation shaft;

a stator provided at an outer circumferential surface of the rotor and separated from the rotor by a predetermined gap;

a casing, including:

a motor chamber, the stator being inserted into the motor chamber and dividing the motor chamber into a first space and a second space;

an inlet port fluidly coupled with the first space to guide a refrigerant toward the motor chamber; and a suction guide passage formed in the second space to guide the refrigerant sucked through the inlet port toward the compression unit;

an oil supply passage provided in the rotation shaft to guide oil to bearing portions supporting the rotation shaft; and a communication passage portion in the rotation shaft configured to communicate the first space and the second space, wherein the oil supply passage is formed along an axial direction of the rotation shaft at the one end of the rotation shaft, wherein the communication passage portion is formed along the axial direction at the another end of the rotation shaft, and wherein the communication passage portion comprises:

a first communication hole formed within the rotation shaft in the axial direction, one end of the first communication hole being open to communicate with the first space, and another end of the first communication hole being entirely closed in the axial direction of the rotation shaft so as to be axially separated from the oil supply passage; and at least one second communication hole extending between an inner circumferential surface of the first communication hole and an outer circumferential surface of the rotation shaft.

2. The compressor of claim 1, wherein an inner diameter of the first communication hole is larger than or equal to an inner diameter of the oil supply passage.

3. The compressor of claim 1, wherein the second communication hole is formed at a position radially overlapping a coil located in the second space, and wherein one end of the second communication hole is opened to communicate with the first communication hole, and another end of the second communication hole is opened to communicate with the second space.

4. The compressor of claim 1, wherein the stator comprises a stator core having a plurality of teeth positioned on an inner circumferential surface thereof along a circumferential direction, and wherein an outer diameter of the stator core is the same as an inner diameter of the casing in contact with an outer circumferential surface of the stator core.

5. The compressor of claim 1, wherein the casing includes a communication groove formed on an inner circumferential surface of the casing, the communication groove fluidly communicating the first space and the second space.

6. The compressor of claim 5, wherein the communication groove is connected to the suction guide passage.

* * * * *